US006125581A

United States Patent [19]

Grossman

[11] Patent Number: 6,125,581

[45] Date of Patent: Oct. 3, 2000

[54] ADJUSTABLE SIZE SHUTTER

[75] Inventor: Isaac Grossman, Brooklyn, N.Y.

[73] Assignee: Achim Importing Co., Inc., Brooklyn, N.Y.

[21] Appl. No.: 09/132,192

[22] Filed: Aug. 11, 1998

[51] Int. Cl.[7] ..... E06B 7/08

[52] U.S. Cl. ..... 49/74.1; 49/504

[58] Field of Search ..... 49/74.1, 73, 124, 49/207, 504, 505, 501; 52/473, 455, 457

[56] References Cited

U.S. PATENT DOCUMENTS

| | | | |
|---|---|---|---|
| 377,987 | 2/1888 | Boughton . | |
| 380,747 | 4/1888 | Dowling . | |
| 447,934 | 3/1891 | Boughan . | |
| 516,289 | 3/1894 | Weglein, Jr. . | |
| 531,828 | 1/1895 | Blaine . | |
| 953,995 | 4/1910 | Gray | 49/505 X |
| 998,464 | 7/1911 | Cannon . | |
| 1,458,025 | 6/1923 | Biele . | |
| 1,496,525 | 6/1924 | Coco . | |
| 2,736,930 | 3/1956 | Longley . | |
| 2,856,040 | 10/1958 | Dansereau . | |
| 3,553,891 | 1/1971 | Casebolt et al. . | |
| 3,864,887 | 2/1975 | Arens . | |
| 3,932,959 | 1/1976 | Jansons et al. | 49/74.1 |
| 4,589,229 | 5/1986 | Warren . | |
| 4,850,144 | 7/1989 | Grisham et al. | 49/501 X |
| 5,430,986 | 7/1995 | Vagedes | 52/473 |
| 5,524,407 | 6/1996 | Ricard et al. | 52/473 |
| 5,555,923 | 9/1996 | Leist et al. | 49/501 X |
| 5,845,439 | 12/1998 | Hendley | 49/505 X |

FOREIGN PATENT DOCUMENTS 2241684 3/1975 France .

*Primary Examiner*—Jerry Redman
*Attorney, Agent, or Firm*—Amster, Rothstein & Ebenstein

[57] ABSTRACT

A kit for an adjustable size shutter includes a shutter panel and a mounting member fastenable to a window support, the mounting member being pivotably securable to the panel at one end thereof and defining at an opposite end thereof a longitudinally extending mortise. The kit further includes a size adjustment member of a first width defining at one end thereof a longitudinally extending mortise and at an opposite end thereof a longitudinally extending tenon configured and dimensioned to be received within the mounting member mortise. The kit may additionally include an additional size adjustment member of a second width. In another embodiment, the kit includes a mounting member fastenable to a window support, and a shutter panel pivotably securable to the mounting member at one end thereof and defining at the opposite end thereof a longitudinally extending mortise. The kit further includes a size adjustment member defining at one thereof a longitudinally extending mortise and at an opposite end thereof a longitudinally extending tenon configured and dimensioned to be received within the panel mortise.

3 Claims, 4 Drawing Sheets

ADJUSTABLE SIZE SHUTTER

BACKGROUND OF THE INVENTION

The present invention relates to a kit for a shutter, and more particularly to a kit for an adjustable size shutter.

A conventional shutter comprises a shutter panel and a mounting member therefore. The shutter panel may be formed of a plurality of sub-panels which are hingedly, and therefore pivotably, secured together. The mounting member is fastenable to a window support which, where the window is flush with the building front wall, may be the building front or, where the window is recessed inwardly from the building front wall, a side of the recess. Both constructions are well known in the art. Typically, the mounting member is either screwed into or nailed to the window support.

The prior art shutters have not proven to be entirely satisfactory to users thereof. In particular, while it is typically desired that the two shutters (one extending from each side of the window width) meet in the center of the window width in order to provide the symmetry and full protection of the window, in fact it sometimes happens that either the two shutters do not meet at all or possibly meet at a point which is not along the longitudinal line of symmetry of the window. Further, while some users prefer that the mounting member fully cover the window frame or a portion of the building front wall side (thereby to conceal the appearance of the window frame or wall portion with the shutter), in some instances the mounting member is of lesser width than the window frame or front wall portion and thus cannot entirely cover the same.

Typically, the above-mentioned problems associated with conventional shutters are capable of being remedied by a craftsman who creates and secures an extension member to the free end of the shutter panel (in the first case mentioned above) or the free end of the mounting member (in the second case mentioned above). However, such extension members have not been proven to be securely attachable to the shutter panel, (in the first case mentioned above) so as to prevent direct transverse separation thereof, due to the customary movement of the shutter panel by the user grasping the extension member thereon. While the shutter panel/extension member connection is not subject to great forces tending to move one longitudinally relative to the other, there is a significant force customarily exerted during opening and closing of the shutter to directly transversely pull the extension member from the shutter panel.

In any case, the design, implementation and installation of the extension member would be faster, easier and much cheaper if a preformed extension member could be added to the shutter panel or mounting member, as necessary, by the typical shutter purchaser without the need for employment of a skilled construction person.

Accordingly, it is an object of the present invention to provide a kit for an adjustable size shutter.

Another object is to provide such a kit wherein in one embodiment the effective width of the shutter panel may be increased.

A further object is to provide such a kit wherein in one embodiment the effective width of the mounting member may be increased.

It is also an object of the present invention to provide such a kit wherein in one embodiment the effective width of both the shutter panel and the mounting member may be increased.

It is also an object to provide such a kit wherein the shutter size is adjustable by a typical purchaser thereof, without skilled labor.

It is another object to provide such a kit which provides an adjustable size shutter which is simple and inexpensive to make, install, use and maintain.

SUMMARY OF THE INVENTION

It has now been found that the above and related objects of the present invention are obtained in a kit for an adjustable size shutter.

In a first preferred embodiment, the kit for an adjustable size shutter comprises a shutter panel and a mounting member fastenable to a window support, the mounting member being pivotably securable to the panel at one end thereof and defining at an opposite end thereof a longitudinally extending mortise. The kit further includes a size adjustment member of a first width defining at one end thereof a longitudinally extending mortise and at an opposite end thereof a longitudinally extending tenon configured and dimensioned to be received within the mounting member mortise, and optionally at least one additional size adjustment member of a second width defining at one end thereof a longitudinally extending mortise and at an opposite end thereof a longitudinally extending tenon configured and dimensioned to be received within the mounting member mortise.

In a preferred embodiment, each mortise is a fan-shaped mortise, and each tenon is a fan-shaped tenon, each mortise and each tenon being configured and dimensioned to form together a dovetail joint. Thus, the mounting member and the adjustment member are securable together against direct transverse separation thereof without the use of tools or adhesive. Preferably the mounting member defines at least one aperture extending transversely therethrough (preferably through the mortise of the mounting member) for locking the mounting member and the adjustment member against relative longitudinal displacement.

Preferably the first and second widths of the adjustment members are the same, and the mortise of the adjustment member is configured and dimensioned to receive the tenon of the additional adjustment member preferably through the mortise of the mounting member.

In a second preferred embodiment, the kit for an adjustable size shutter comprises a mounting member fastenable to a window support, and a shutter panel pivotably securable to the mounting member at one end thereof and defining at an opposite end thereof a longitudinally extending mortise. The kit further includes a size adjustment member of a first width defining at one end thereof a longitudinally extending mortise and at an opposite end thereof a longitudinally extending tenon configured and dimensioned to be received within the panel mortise, and optionally at least one additional size adjustment member of a second width defining at one end thereof a longitudinally extending mortise and at an opposite end thereof a longitudinally extending tenon configured and dimensioned to be received within the panel mortise.

In a preferred embodiment, each mortise is a fan-shaped mortise, and each tenon is a fan-shaped tenon, each mortise and each tenon being configured and dimensioned to form together a dovetail joint. Thus, the adjustment member and the panel are securable together against direct transverse separation thereof without the use of tools or adhesive. Preferably the panel defines at least one aperture at least partially extending transversely therethrough (preferably through the mortise of the panel) for locking the panel and the adjustment member against relative longitudinal displacement.

Preferably the first and second widths of the adjustment members are the same, and the mortise of the adjustment member is configured and dimensioned to receive the tenon of the additional adjustment member.

In a third preferred embodiment, the kit comprises the shutter panel of the second embodiment, the mounting member of the first embodiment and at least two size adjustment members.

BRIEF DESCRIPTION OF THE DRAWING

The above and related objects, features and advantages of the present invention will be more fully understood by reference to the following detailed description of the presently preferred, albeit illustrative, embodiments of the present invention when read in conjunction with the accompanying drawing wherein.

DETAILED DESCRIPTION OF THE PREFERRED EMBODIMENTS

Figure 1:
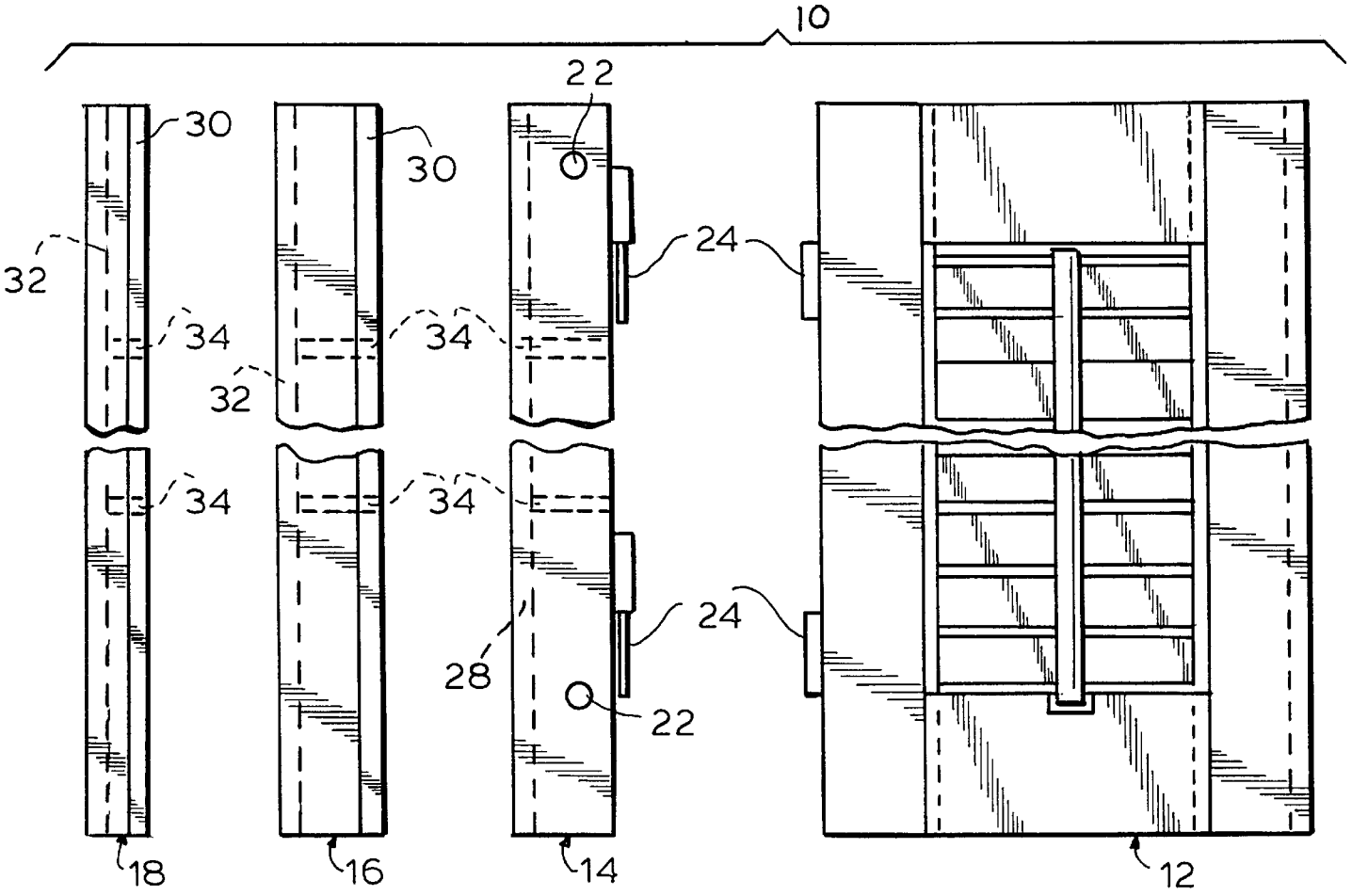
FIG. 1 is an exploded front elevational view of the components of a kit for an adjustable size shutter according to a first embodiment of the present invention.

Referring now to the drawing, and in particular to FIG. 1 thereof, therein illustrated in an exploded view are the components of a kit for an adjustable size shutter according to a first embodiment of the present invention, the kit of the first embodiment being generally designated by the reference numeral 10. The kit components include a shutter panel, generally designated 12, a mounting member, generally designated 14, a first size adjustment member, generally designated 16, and a second or additional size adjustment member, generally designated 18.

The shutter panel 12 and the mounting member 14 are of conventional construction except as indicated below. Thus, the shutter panel 12 may be comprised of a plurality of sub-panels—whether louvered or not—pivotably connected together so that the plurality of sub-panels may, at one extreme, overlie one another, and, at the opposite extreme, lie along a common transverse plane. The mounting member 14 may typically be provided with a plurality of holes 22 to facilitate securing the mounting member 14 to an appropriate window support (not shown), whether that window support is the outer front wall of the building for a flush window or the side of a window frame for a recessed window. One end of the shutter panel 12 is pivotably securable to one end of the mounting member 14, for example, by means of pin and hinge assemblies 24, as illustrated, although alternative pivotable securing means may be employed instead.

Unlike the conventional mounting member, the mounting member 14 of the present invention defines at its free longitudinal end 14*a* (that is, the longitudinal end opposite the end to which the shutter panel 12 is attached) a longitudinally extending mortise 28.

The kit additionally includes at least one basic size adjustment member 16 of a first width and, optionally, an additional size adjustment member 18 of a second width. Thus, for example, the basic size adjustment member 16 may have a width of 0.5 inch and the additional size adjustment member 18 may have a width of 1.0 inch, thereby to enable a total coverage of 1.5 inches. Alternatively, the two adjustment members 16, 18 may be the same width, say 0.5 inch, so as to enable a total coverage of 1 inch. Clearly, any number of additional size adjustment members may be present in the kit to enable further extension of the shutter.

Each of the size adjustment members 16, 18 defines at one end thereof a longitudinally extending mortise 30 and at the opposite longitudinal end thereof (that is, the longitudinal end of the adjustment member opposite the end to which the shutter panel 12 is attached, directly or indirectly) a longitudinally extending tenon 32 configured and dimensioned to be received within the mounting member mortise 28. Since the tenon 32 of each auxiliary member 16, 18 is adapted to be received within the mortise 28 of the mounting member 14, either of the adjustment members 16, 18 may be directly connected to the free end of the mounting member 14 so as to form a mortise/tenon assembly formed of mortise 28 and tenon 32.

The mortises 30 of the adjustment members 16, 18 are configured and dimensioned the same as the mortise 28 of the mounting member 14 so that the adjustment member mortises 30 can receive the tenons 32 of any adjustment member 16, 18. For example, the mortise 30 of the adjustment member 16 is configured and dimensioned to receive the tenon 32 of the additional adjustment member 18.

Preferably, the mounting member 14 and the adjustment member 16, or the basis adjustment member 16 and the additional adjustment member 18, are securable together against direct transverse separation thereof (that is, a transverse separation not preceded by a longitudinal relative movement of the pieces to separate them) without the use of tools or adhesives. Thus, each of the mortises 28, 30 is preferably a fan-shaped mortise, and each of the tenons 32 is a fan-shaped tenon. Each mortise 28, 30 and each tenon 32 is configured and dimensioned to form together a dovetail joint which strongly resists direct transverse separation of its components while allowing easy tool-free assembly of the components by a relative longitudinal movement.

In the preferred embodiment illustrated, the mounting member 14 defines at least one optional transversely extending aperture 34, and preferably a longitudinally spaced pair of such apertures 34, extending transversely therethrough (from one longitudinal end at least towards the other longitudinal end). This enables an efficient and easy locking of the mounting member 14 and the adjustment members 16, 18 secured thereto against relative longitudinal displacement simply by inserting a joining pin or screw through the transversely extending apertures 34 of the mounting member 14 and the adjacent adjustment member 16, 18. Two adjacent adjustment members 16, 18 may also be locked together against relative simply longitudinal displacement by a pin or screw extending through the transversely extending apertures 34 of the adjustment members 16, 18. Preferably at least one of the optional transversely extending apertures 34 extends transversely through (i.e., into) the mortise 28 of mounting member 14.

It will be appreciated by those skilled in the art that, if the mounting member 14 and the adjacent adjustment members 16, 18 are secured together against direct transverse separation thereof and against relative longitudinal displacement thereof, there is no danger of separation of the shutter components. The dovetail connection formed by a mortise 28, 30 and a tenon 32 is very strong. As there is little tendency for the adjustment members 16, 18 to undergo longitudinal displacement relative to the mounting member 14 or each other, only minimal skill is necessary in order to properly place a pin or screw through the apertures 34.

Figure 2:
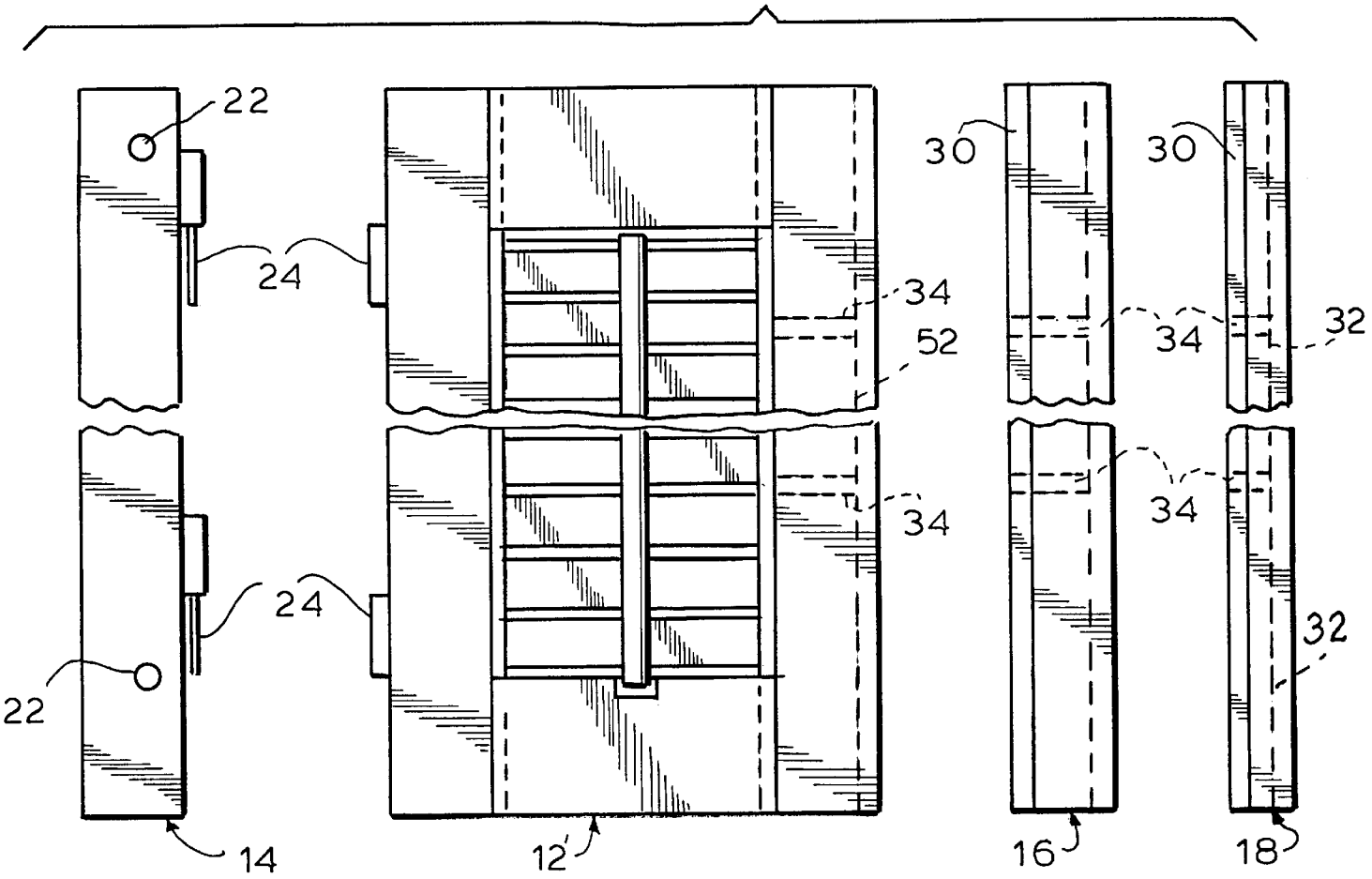
FIG. 2 is an exploded front elevational view of the components of a kit for an adjustable size shutter according to a second embodiment of the present invention.

Referring now to FIG. 2 in particular, therein illustrated in an exploded view are the components of a kit for an adjustable size shutter according to a second embodiment of the present invention, generally designated 50. Like reference numerals have been used to designate elements of the second embodiment 50 which are similar in function or structure to the corresponding elements of the first embodiment 10.

Thus, in the second embodiment 50, the mounting member 14' is attachable to the window support (not shown), the shutter panel 12' is pivotably securable to the mounting member 14', and one or more size adjustment members 16, 18 are securable to the shutter panel 12' such that the tenon 30 of an adjacent adjustment member 16, 18 enters the mortise 52 of the shutter panel 12', and/or to an adjacent adjustment member 16, 18 such that the tenon 30 of one adjustment member 16, 18 enters the mortise 32 of the adjacent adjustment member 16, 18.

In the second embodiment 50, the adjustment members 16, 18 are identical to the adjustment members 16, 18 of the first embodiment 10. The mounting member 14' of the second embodiment 50 is similar to the mounting member 14 of the first embodiment 10, except that it does not necessarily have (and is illustrated as not having) a mortise 28 extending longitudinally along the free end thereof. The shutter panel 12' differs from the shutter panel 12 of the first embodiment in that, at the free longitudinal end thereof (i.e., at the longitudinal end thereof opposite from the end adjacent the mounting member 14') there is a longitudinally extending mortise 52 adapted to receive a tenon 30 of one of the adjustment members 16, 18. Additionally, the optional tranversely extending apertures 34 of shutter panel 12' only need extend at least partially therethrough in order to effect simplified locking of the panel and an adjacent member 16, 18 against relative longitudinal displacement. Preferably at least one of the optional transversely extending aperture extends transversely through (i.e., into) the mortise 52 of shutter panel 12'

Figure 3:
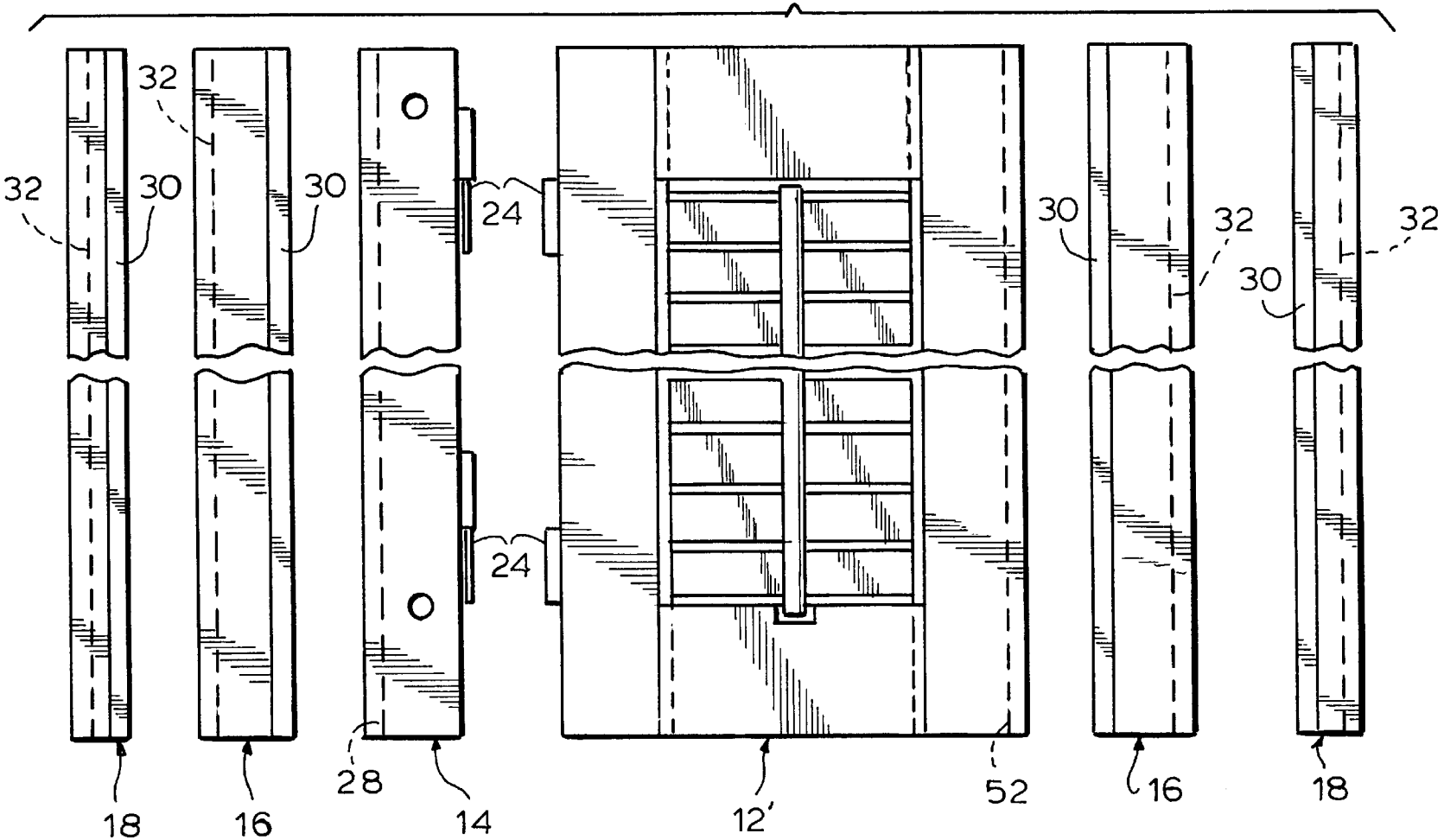
FIG. 3 is an exploded front elevational view of the components of a kit for an adjustable size shutter according to a third embodiment of the present invention.
Figure 4:
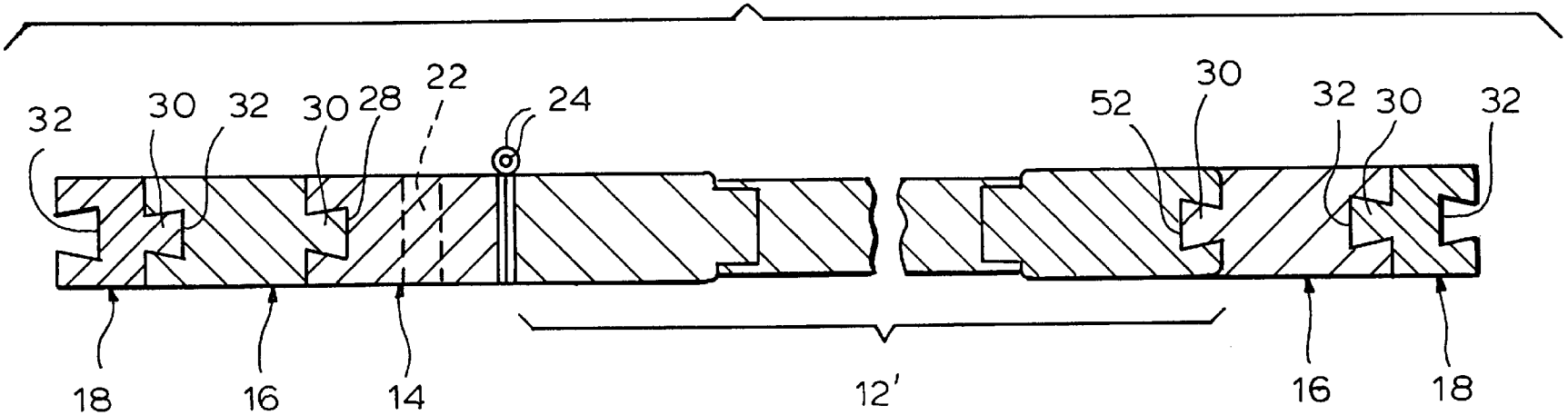
FIG. 4 is a top view of FIG. 3.

Referring now to FIG. 3 in particular, therein illustrated are the components of a kit for an adjustable sized shutter according to a third embodiment of the present invention, generally designated 100. Like reference numerals have been used to designate elements of the third embodiment 100 which are similar in function and structure to the corresponding elements of the first embodiment 10 or second embodiment 15.

While the components of shutter 100 are illustrated for pedagogic purposes without the transversely extending apertures 34, clearly such transversely extending apertures 34 may be present in the third embodiment.

As illustrated, the kit 100 includes as components at least a pair of basic size adjustment members 16 (and optionally at least one additional size adjustment member 18), the shutter panel 12' from the second embodiment 50 defining a mortise 52, and the mounting member 14 of the first embodiment 10 defining a mortise 28. Thus, in the third embodiment 100, the shutter panel 12' is pivotably securable to the mounting member 14 to form a sub-assembly, with the sub-assembly defining at one free longitudinal end a mortise 52 (on the shutter panel 12') and at the other free longitudinal end a mortise 28 (on the mounting member 14). An adjustment member 16 is securable to each free longitudinal end of the sub-assembly, with one or more additional adjustment members 18 being securable to each adjustment member 16.

As a practical matter, the kit may provide the user thereof with the ultimate in flexibility by including only the shutter panel 12' and the mounting member 14, both as disclosed in the third embodiment 100, as a sub-kit. The sub-kit purchaser may then select and separately purchase one or more adjustment members 16, 18 for use on either the shutter panel free end, the mounting member free end, or another adjustment member 16, 18. Similarly, if desired, the shutter panel 12 and mounting member 14 of the first embodiment 10 may be sold as a sub-kit—separately from the adjustment members 16, 18—and the shutter panel 12' and mounting member 14' of the second embodiment 50 may be sold as a sub-kit—separately from the adjustment members 16, 18—and the shutter panel 12' and the mounting member 14 of the third embodiment 100 may be sold as a sub-kit.

For the purposes of the present application, the sale of a shutter panel and mounting member (whether shutter 12 and mounting member 14, or shutter 12' and mounting member 14', or shutter 12' and mounting member 14) as a sub-kit for use with one or more size adjustment members 16, 18 is deemed to be a kit according to the present invention, regardless of the physical separation or separate pricing of the adjustment member(s) 16, 18 from the sub-kit at the time of sale.

Accordingly, the present invention provides a kit for an adjustable size shutter wherein in a first embodiment the effective width of the mounting member may be increased, in a second embodiment the effective width of the shutter panel may be increased, and in a third embodiment both effective widths may be increased. The shutter size is adjustable by a typical purchase thereof without skilled labor. The kit provides an adjustable size shutter which is simple and inexpensive to make, install, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. An adjustable size shutter fastened to a window support in a vertical orientation, comprising:

(A) a longitudinally extending shutter panel pivotably secured to a mounting member at one longitudinal end thereof and defining at an opposite longitudinal end thereof a longitudinally extending mortise;

(B) a longitudinally extending mounting member fastened to a window support in a vertical orientation, said mounting member being pivotably secured to said panel at one longitudinal end thereof and defining at an opposite longitudinal end thereof a longitudinally extending mortise;

(C) a longitudinally extending size adjustment member defining at one longitudinal end thereof a longitudinally extending mortise and at an opposite longitudinal end thereof a longitudinally extending tenon configured and dimensioned to be received within said mounting member mortise; and (D) a longitudinally extending size adjustment member defining at one longitudinal end thereof a longitudinally extending mortise and at an opposite longitudinal end thereof a longitudinally extending tenon configured and dimensioned to be received within said panel mortise.

2. The shutter of claim 1 wherein each said mortise is a fan-shaped mortise, and each said tenon is a fan-shaped tenon, each said mortise and each said tenon being configured and dimensioned to form together a dovetail joint.

3. An adjustable size shutter fastened to a window support in a vertical orientation, comprising:

(A) a longitudinally extending shutter panel pivotably secured to a mounting member at one end thereof and defining at an opposite end thereof a longitudinally extending female engaging member;

(B) a longitudinally extending mounting member fastened to a window support in a vertical orientation, said mounting member being pivotably secured to said panel at one end thereof and defining at an opposite end thereof a longitudinally extending female engaging member;

(C) a longitudinally extending size adjustment member defining at one end thereof a longitudinally extending female engaging member and at an opposite end thereof a longitudinally extending male engaging member configured and dimensioned to be received within said female engaging member of said mounting member; and (D) a longitudinally extending size adjustment member defining at one end thereof a longitudinally extending female engaging member and at an opposite end thereof a longitudinally extending male engaging member configured and dimensioned to be received within said female engaging member of said panel.

* * * * *